US005979559A

United States Patent [19]

Kennedy

[11] Patent Number: 5,979,559

[45] Date of Patent: Nov. 9, 1999

[54] APPARATUS AND METHOD FOR PRODUCING A GRAVITY SEPARATED WELL

[75] Inventor: Steven C. Kennedy, Bartlesville, Okla.

[73] Assignee: Camco International Inc., Houston, Tex.

[21] Appl. No.: 08/886,654

[22] Filed: Jul. 1, 1997

[51] Int. Cl.[6] ..... E21B 43/12; E21B 43/38

[52] U.S. Cl. ..... 166/369; 166/66.4; 166/106

[58] Field of Search ..... 166/369, 65.1, 166/66.4, 106

[56] References Cited

U.S. PATENT DOCUMENTS 4,241,787 12/1980 Price ..... 166/106 X
5,180,014 1/1993 Cox ..... 166/66.4 X
5,497,832 3/1996 Stuebinger et al. ..... 166/106 X
5,697,448 12/1997 Johnson ..... 166/106 X
5,842,520 12/1998 Bolin ..... 166/106 X

*Primary Examiner*—Roger Schoeppel
*Attorney, Agent, or Firm*—Fletcher, Yoder & Van Someren

[57] ABSTRACT

A method and apparatus are disclosed for producing a gravity separated well in which water and oil are permitted to separate under the influence of gravity. A pumping unit, including an oil pump and a water pump, is positioned in the well. A drive motor may be close coupled with the pumps. The pumping unit may be positioned in the oil region, the water region or in an interface region therebetween. A discharge line extends from the oil pump to a location above the earth's surface, while another discharge line extends from the water pump to a location adjacent to a water injection zone of the well. At least one of the pumps includes a remote intake for drawing fluid from the region in which the unit is not positioned. The technique permits the pumps to be positioned in the well and driven without the need for extended power transmission elements between the pumps.

29 Claims, 5 Drawing Sheets

APPARATUS AND METHOD FOR PRODUCING A GRAVITY SEPARATED WELL

BACKGROUND OF THE INVENTION

1. Field of the Invention

The present invention relates generally to the field of petroleum production. More particularly, the invention relates to the collection of petroleum products from a gravity separated well and to the disposal of non-production fluids in such wells.

2. Description of the Related Art

While the need for petroleum products, such as oil and natural gas, has increased in recent years, available reserves for such resources have become ever more scarce. Reserves now being exploited often pose difficult challenges in terms of the efficient removal of the products of interest, typically oil and gas, and the disposal of other fluids, such as water. Producing wells are generally exploited by perforating a wellbore lined with a well casing in one or more regions in which oil is believed to lie, permitting the oil to flow into the wellbore. Depending upon the composition of the underground formations, a significant amount of water may also enter the wellbore along with the oil. Conventionally, the mixture of oil and water (along with any other entrained contaminants) is pumped to the earth's surface where the oil is separated out of the mixture and stored. Separated water may then be reinjected at designated disposal regions within the same or a different well. It should be noted that, as used herein, "oil" is often a mixture of oil and water and "water" is primarily water containing only trace amounts of oil.

In another known technique, the mixture of oil and water is allowed to separate within the well under the influence of gravity. Wells of this type are often referred to as "gravity separated" wells. Because the oil and water are generally immiscible and the oil is lighter than the water, regions of oil and water will eventually form within the well with the oil region overlying the water region. The oil may then be pumped from the oil region, and the water may be removed from the well or directly reinjected at a designated disposal region. In one known arrangement, a pair of pumps are disposed in the well, one within the oil region and another within the water region. The pumps are linked to one another via a sucker rod and actuated by movement of the rod. In another known arrangement, two pumps are coupled to separate drive motors. A pump/motor assembly is then positioned within each of the oil and water regions of the well to pump oil to the earth's surface and water into a disposal region.

Existing techniques for exploiting gravity separated wells suffer from several drawbacks. For example, where separate reciprocating pumps are positioned in the oil and water regions of the well and connected to one another by a sucker rod, the actuating rod itself may be several hundred or even thousands of feet in length, requiring substantial effort to raise and lower the rod to drive the pumps. In addition, such arrangements typically provide only a relatively low flow rate of oil from the well.

There is a need, therefore, for an improved technique for extracting production fluids from gravity separated wells. In particular, there is a need for a system that permits oil to be raised to the earth's surface from an oil region of the well, while disposing of water from a water region, without recourse to pumps separated by large distances within the well.

SUMMARY OF THE INVENTION

The present invention provides an apparatus and method for producing a gravity separated well designed to respond to these needs. The technique employed by the invention advantageously permits both oil and water pumps to be driven by a single drive motor, without the need to extend drive shafts or sucker rods between the pumps. The pumps are advantageously close coupled to one another, and to the drive motor, and may be positioned within the oil or water region of the gravity separated well, or at any location therebetween. A remote intake is extended from at least one of the pumps to draw fluid from the region which is remote from that within which the pumping unit is positioned. To ensure that the pumps continue to draw from the appropriate regions, remote intakes may be extended from both pumps, permitting substantial movement of the interface between the oil and water regions without adversely affecting the operation of the pumps. The technique may be employed in gravity separated wells having various configurations and traversing production and water discharge zones in any order.

Thus, in accordance with one aspect of the invention, an apparatus is provided for producing a gravity separated well. The well includes a wellbore traversing an oil producing zone and a water injection zone. The well permits entry of water and oil into the wellbore, the oil and water at least partially separating under the influence of gravity to define an oil region and a water region within the wellbore. The apparatus includes first and second pumps and a drive motor. The first pump has a first inlet disposed in the oil region and a first outlet above the earth's surface for discharging oil. The second pump has a second inlet disposed in the water region and a second outlet disposed adjacent to the water injection zone. The drive motor is close coupled to the first and second pumps for driving the first and second pumps. The first pump thus draws oil from the oil region and discharges oil through the first outlet, while the second pump draws water from the water region and discharges water to the water injection zone.

In accordance with another aspect of the invention, an apparatus for producing a gravity separated well includes a first pump having a remote first inlet disposed in the oil region for drawing oil from the oil region, and a remote first outlet disposed above the earth's surface for discharging oil. A second pump is disposed adjacent to the first pump and has a second inlet in the water region for drawing water from the water region, and a remote second outlet in the water injection zone. A drive motor is operatively coupled to the first and second pumps. The first pump thus draws oil from the oil region and discharges oil through the first outlet, and the second pump draws water from the water region and discharges water to the water injection zone.

In accordance with a further aspect of the invention, the first pump has a first inlet disposed in the oil region for drawing oil from the oil region, and a remote first outlet disposed above the earth's surface for discharging oil. The second pump is disposed adjacent to the first pump and has a remote second inlet in the water region for drawing water from the water region, and a remote second outlet in the water injection zone. A drive motor is operatively coupled to the first and second pumps. The first pump draws oil from the oil region and discharges oil through the first outlet, while the second pump draws water from the water region and discharges water to the water injection zone.

In accordance with still another aspect of the invention, a submersible pumping unit includes a first pump, a second pump and a drive motor close coupled with the first and second pumps for driving the first and second pumps. First intake means is coupled to the first pump for drawing fluid from the oil region into the first pump. Second intake means is coupled to the second pump for drawing fluid from the water region into the second pump. First discharge means is coupled to the first pump for discharging fluid from the first pump to a location above the earth's surface; and second discharge means is coupled to the second pump for discharging fluid from the second pump to a location adjacent to the water discharge zone. At least one of the first or second intake means extends remotely from the pumping unit.

The invention also provides a method for producing a gravity separated well in which a pumping unit is positioned in a first region of the well. The pumping unit includes a first pump and a second pump, the first and second pumps being close coupled to one another. The first pump has a first inlet and a first outlet, while the second pump has a second inlet and a second outlet. In accordance with the method, a remote intake is extended from the second pump to the second region. The first and second pumps are driven via a drive motor to draw fluid from the first region into the first pump and discharge fluid from the first region via the first outlet. The drive motor also permits fluid to be drawn from the second region into the second pump via the remote intake and discharged from the second pump via the second outlet.

In accordance with another aspect of the method, a pumping unit is positioned in the wellbore, the pumping unit including a first pump, a second pump and a drive motor. The first pump, the second pump and the drive motor are close coupled to one another. The first pump has a first inlet and a first outlet, while the second pump has a second inlet and a second outlet. A remote intake is extended from the first inlet to the first region, and the first and second pumps are driven by the drive motor. Fluid is thus drawn from the first region into the first pump via the remote intake and discharged via the first outlet. Similarly, fluid is drawn from the second region into the second pump and discharged from the second pump via the second outlet.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
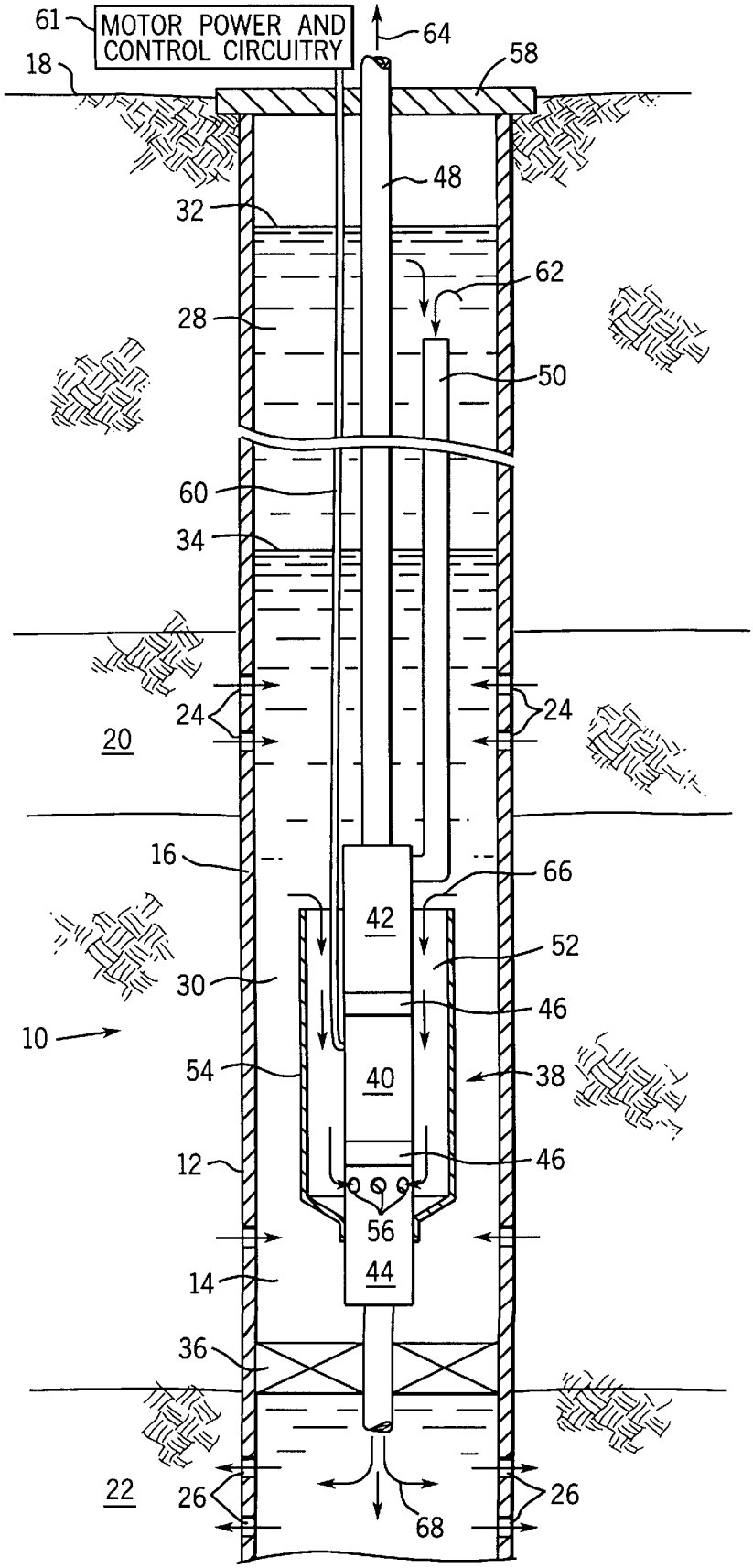
FIG. 1 is an elevational view of a tool string including a pumping system positioned in water-filled zone of a gravity separated well, the pumping unit comprising a pair of pumps having inlets in the water-filled and oil-filled regions of the well.

Turning now to the drawings, and referring first to FIG. 1, a well production system is illustrated diagrammatically, and designated generally by the reference numeral 10, for extracting oil from a gravity separated well 12. Well 12 includes a wellbore 14 bounded by a well casing 16 along its length. Well 12 extends from the earth's surface 18 through at least one production zone or horizon 20 and a water injection zone 22. Well casing 16 is perforated along its length to permit the inflow of oil and water from production zone 20, and the outflow of water into the injection zone 22. Thus, a plurality of perforations 24 are formed in casing 16 adjacent to production zone 20, while a series of similar perforations 26 are formed adjacent to water injection zone 22. It should be noted that well 12 may be located either beneath dry land or a body of water. Thus, where reference is made in the present description to the earth's surface, that team is extended to encompass both dry land and submerged areas.

Following the inflow of oil and water into wellbore 14, the mixture separates under the influence of gravity to form a first region 28, primarily comprising oil, and a second region 30, primarily comprising water. By virtue of the relative specific gravities of the oil and water, oil region 28 will form generally above water region 30 and is bounded by an oil surface 32 at its upper extremity, and by a water/oil interface region 34 at its lower extremity. It should be noted that the interface region 34 is not abrupt but, rather, spans several feet. In fact, the interface region 34 may span 50 feet, for instance. A packer 36 is positioned within wellbore 14 between production zone 20 and water injection zone 22. Packer 36 forms the lower extremity of water region 30, the upper extremity of water region 30 being water/oil interface region 34.

System 10 includes a pumping unit, designated generally by the reference numeral 38, for pumping oil from oil region 28 to a location above earth's surface 18 and for pumping water from water region 30 into water injection zone 22. Pumping unit 38 includes a drive motor 40, an oil pump 42 and a water pump 44. Pumps 42 and 44 are close coupled within unit 38 and, in the embodiment illustrated in FIG. 1, are close coupled to drive motor 40. By "close coupled" it is meant that the units are not separated by more than the length of the interface region 34. For instance, the units may be directly coupled to one another or coupled by a short (e.g., 50 feet) drive shaft or the like. Pumping unit 38 may be of a type generally referred to in the industry as an electric submergible pump ("ESP"), including a submersible electric motor. Alternatively, motor 40 could be a hydraulic motor powered by a hydraulic power unit (not illustrated) on the earth's surface. In applications where temperatures and pressures within wellbore 14 may result in damage to motor 40, one or more motor protectors 46 may be provided in a manner generally known in the art.

System 10 also includes oil and water inlets and outlets of several possible configurations depending upon the relative positions of oil region 28 and water region 30, and the desired location of pumping unit 38 with respect to these regions. In a first embodiment illustrated in FIG. 1, pumping unit 38 is positioned within water region 30. An oil discharge line 48 extends from oil pump 42 through wellbore 14 to a position above earth's surface 18 for discharging oil displaced by pump 42. A remote oil intake line 50 extends from oil pump 42 into oil region 28. Because pumping unit 38 is located within water region 30, a local water intake 52 is provided adjacent to pumping unit 38. To provide additional cooling for motor 40, water intake 52 may be formed as an annular shroud 54 drawing flow into water pump 44 over motor 40. One or more water intake ports 56 are formed around water pump 44 within shroud 54. A water discharge line 57 is coupled to water pump 44 for discharging water into a region below packer 36, adjacent to water injection zone 22.

At the earth's surface wellbore 14 is closed by a wellhead 58 through which oil discharge line 48 passes, along with a motor control and power line assembly 60. Line assembly 60 includes power conductors for supplying drive power to motor 40 as well as, where appropriate, control or monitoring lines. Line assembly 60 is coupled to motor power and control circuitry 61 above the earth's surface, typically within a control or operator's station (not represented). It should be noted that where motor 40 is other than an electric motor, line assembly 60 will include alternate drive lines for powering and controlling motor 40, such as hydraulic hoses or the like.

In one advantageous embodiment, pumps 42 and 44 are multistage centrifugal pumps close coupled with motor 40. It should be noted, however, that the present arrangement is not limited to any particular type of pump, but may include any suitable pumps, such as a progressive cavity pump. In addition, gear reducers may be associated with one or both pumps to provide a desired drive speed and corresponding flow rate. Similarly, in presently preferred embodiments, remote intake 50 (or other remote intake lines as described below) may include one of several line types, including coil tubing, production tubing, concentric shrouds, and the like.

In operation, system 10 draws oil from oil region 28 and water from water region 30 through operation of pumping unit 38, and discharges oil above earth's surface 18 and water adjacent to water injection zone 22. Thus, as illustrated in FIG. 1, oil is drawn into remote intake 50 by pump 42, as indicated by arrows 62, and discharged through discharge line 48, as indicated by arrow 64. Similarly, water is drawn through a shroud 52 into intake 56 by pump 44, as indicated by arrows 66, and discharged via water discharge line 57, as indicated by arrows 68. Once discharged from line 57, water is forced to penetrate into water injection zone 22 via perforations 26 by pressure exerted by pump 44.

Figure 2:
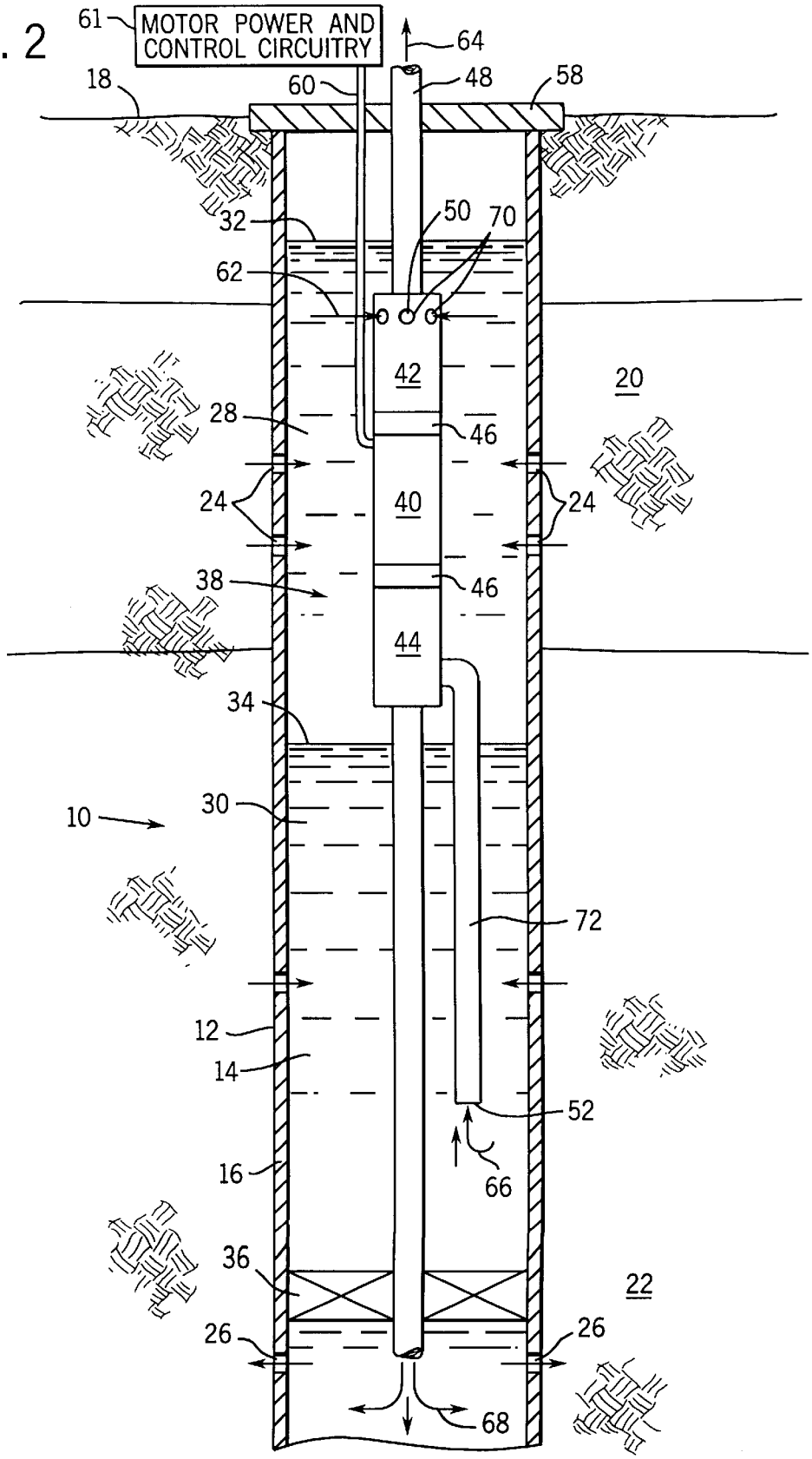
FIG. 2 is an elevational view of an alternative embodiment of the pumping system wherein the pumping unit is disposed in the oil-filled region of a gravity separated well and a remote inlet is positioned in the water-filled region.

FIG. 2 illustrates an alternative configuration in which pumping unit 38 is positioned within oil region 28. Because pumping unit 38 is submerged in oil, the intake 50 supplying oil pump 42 is local to pumping unit 38. In the embodiment illustrated, oil intake 50 comprises a series of intake ports 70 formed around pump 42. For additional cooling of motor 40, a shroud similar to the shroud 56 in FIG. 1 may be provided around a section of oil pump 42 and motor 40. As in the previous embodiment, oil discharge line 48 passes through wellhead 58 to a location above the earth's surface. To ensure that water will be drawn from water region 30, however, water pump 44 is equipped with a remote intake line 72, positioning intake 52 well below oil/water interface 34. As before, water discharge line 57 passes through a lower packer 36 to expel water to a location adjacent to water discharge zone 22.

Figure 3:
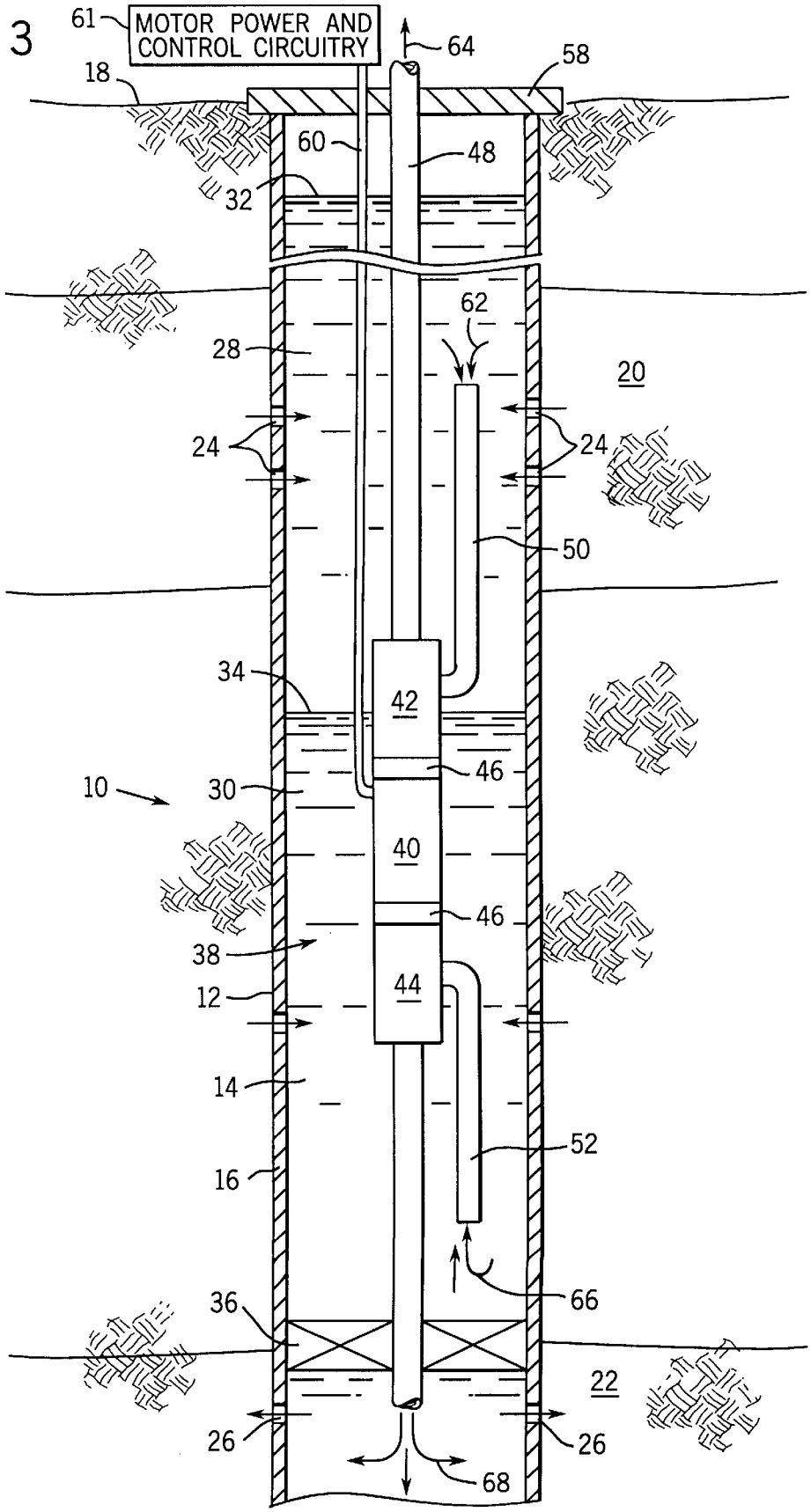
FIG. 3 is an elevational view of another alternative embodiment of the pumping system positioned in a gravity separated well wherein the pumping system includes a pair of remote inlets for drawing oil and water from respective separated regions of the well.

As illustrated in FIG. 3, pumping unit 38 may be equipped with remote intakes lines for both oil pump 42 and water pump 44, permitting pumping unit 38 to be positioned in either oil region 28 or water region 30, or at a location proximate to oil/water interface 34. Thus, as shown in FIG. 3, a remote intake line 50 may extend from pump 42 into oil region 28, while a remote intake line 72 extends into water region 30. This embodiment offers the advantage of allowing pumping unit 38 to be held in a stationary position within wellbore 14 that may from time to time be submerged in either oil or water. The discharge lines for both pumps are generally configured as described above with respect to FIGS. 1 and 2.

Figure 4:
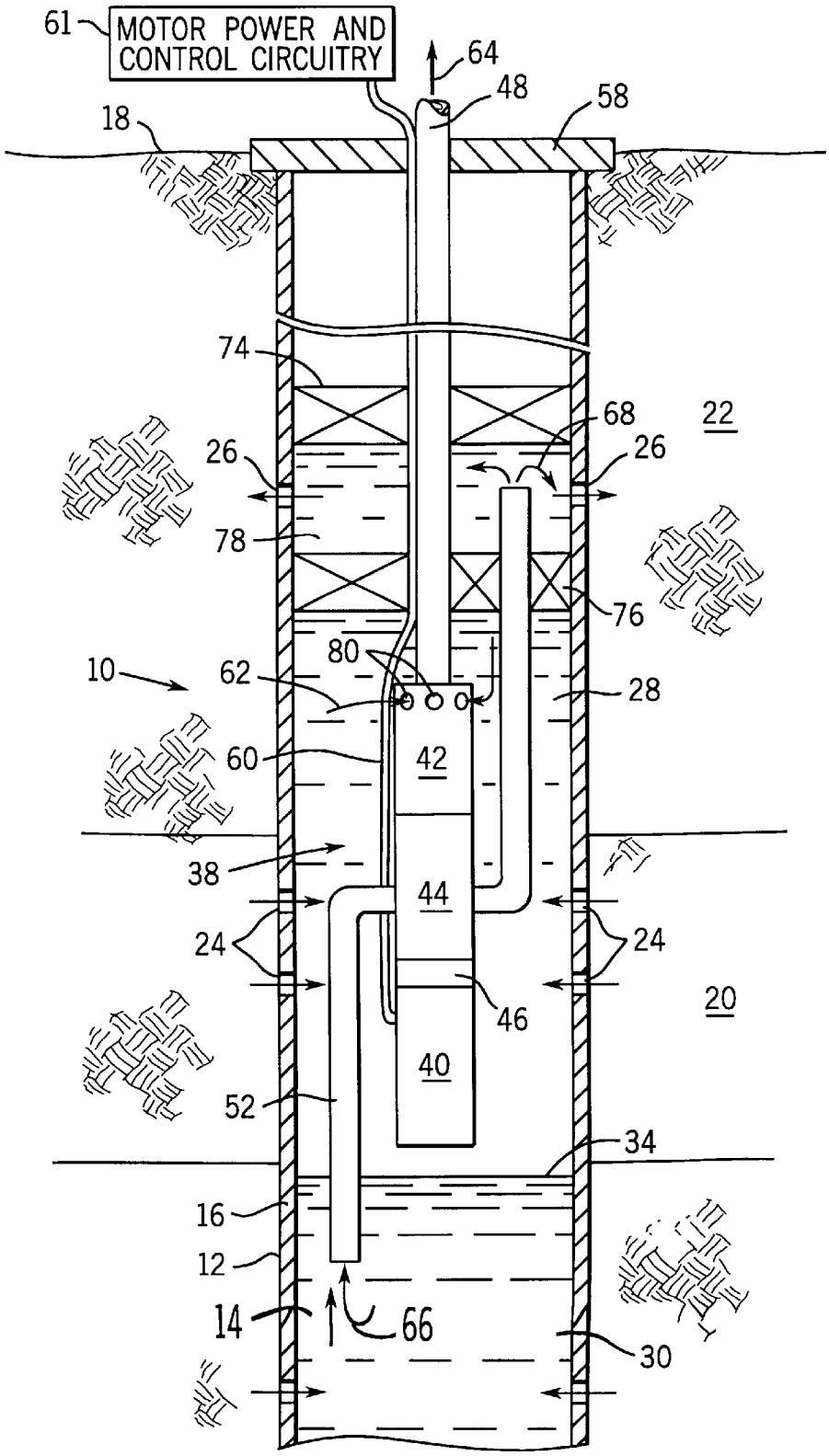
FIG. 4 is an elevational view of a further alternative embodiment of the pumping system adapted for reinjection of water into a discharge zone situated above the production zone.

FIG. 4 illustrates another configuration for pumping unit 38 that is adapted to inject water into a geological horizon above production zone 20. In the particular embodiment shown in FIG. 4, pumping unit 38 is positioned within oil region 28, and includes a remote water intake line 72 extending into water region 30. To isolate water injection zone 22 from oil region 28 and from wellhead 58, upper and lower packers 74 and 76 are sealingly positioned within wellbore 14 isolating an intermediate region 78. A water discharge line 57 passes through lower packer 76 to discharge water displaced by water pump 44 into region 78 isolated by the packers. Oil is drawn into oil pump 42 via intake ports 80, and is discharged through oil discharge line 48, which traverses both upper and lower packers 74 and 76. FIG. 4 illustrates an additional feature of pumping unit 38, whereby drive motor 40 may be positioned at one extremity thereof, and pumps 42 and 44 close coupled to one another. As will be appreciated by those skilled in the art, this arrangement may be favored in certain situations where pump interfaces, drive shafts and couplings enable such connection. As will also be appreciated, this arrangement offers the additional advantage of permitting the use of a single motor protector 46 between the close coupled pumps and motor 40.

It should be noted that various alternative configurations will occur to those skilled in the art for allowing pumping unit 38 to be positioned at different locations with respect to production and discharge zones 20 and 22. Many such configurations may be devised by the appropriate placement of tubing and packers as well as other downhole equipment. For example, the geological arrangement shown in FIG. 4 could be serviced by pumping unit 38 by placing a flow tube through packers 74 and 76 to allow oil and water to flow upwardly therethrough, and then positioning pumping unit 38, configured as in any one of FIGS. 1–3, above packer 74.

Figure 5:
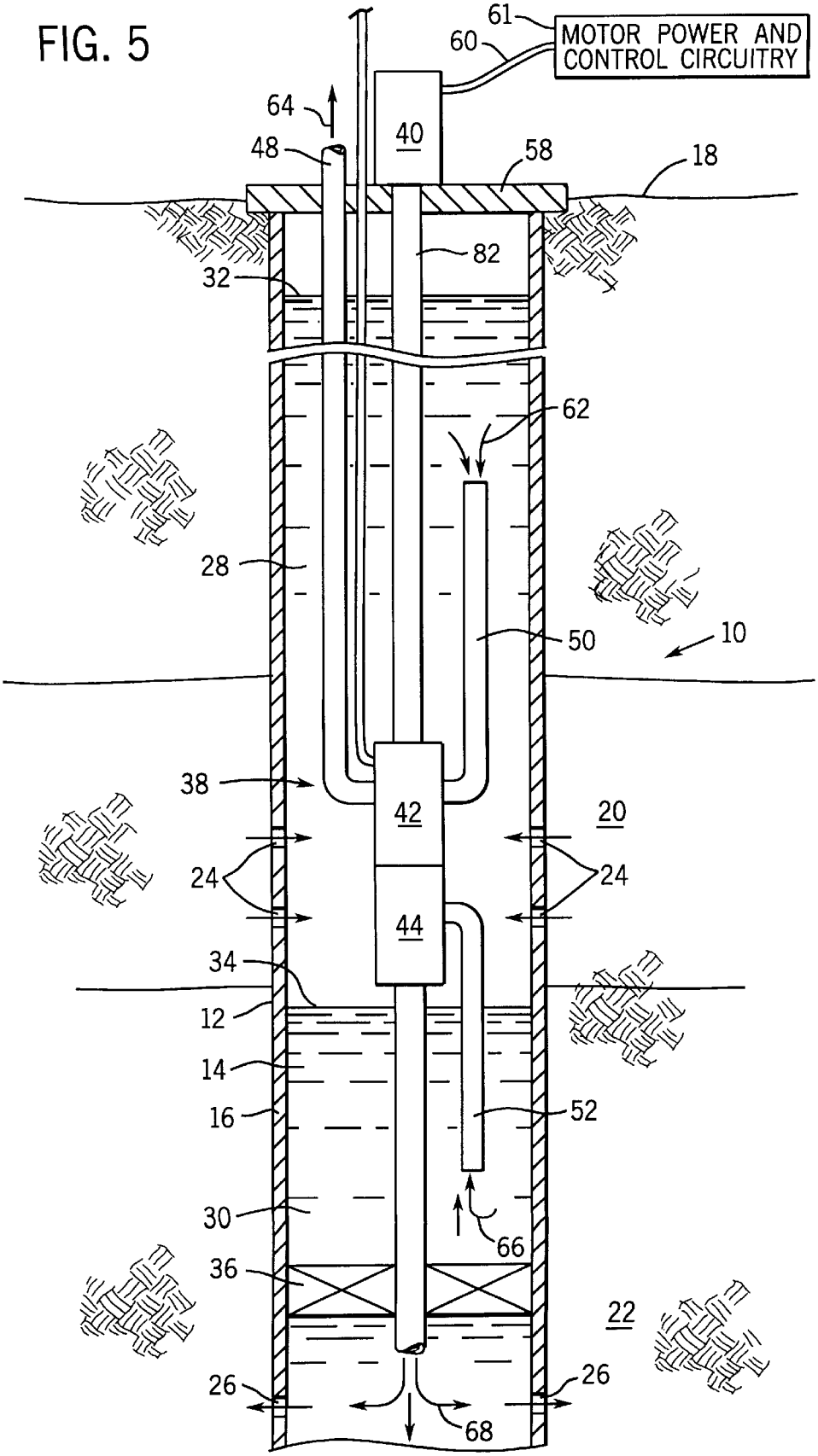
FIG. 5 is an elevational view of an embodiment of the pumping system wherein a drive motor for the water and oil pumps is located above the well and the pumps are positioned within the well to draw water and oil from respective regions thereof.

FIG. 5 illustrates a further alternative configuration of pumping unit 38, wherein drive motor 40 is positioned above the earth's surface, and pumps 42 and 44 are linked to it via a drive shaft 82. As illustrated, both oil pump 42 and water pump 44 are provided with remote intake lines, 50 and 72, respectively. As in the previous embodiments, oil pump 42 discharges oil via discharge line 48, while water pump 44 discharges water adjacent to water injection zone 22 via discharge line 57. It should be noted, however, that where pumping unit 38 is intended to be positioned within one or the other region of well 12, a single remote intake may be provided for drawing fluid from the remaining region. The embodiment of FIG. 5 offers the further advantage of eliminating the need for motor protectors associated with motor 40, even where such protectors might otherwise be needed given the downhole conditions of well 12.

While the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. An apparatus for producing a gravity separated well, the well including a wellbore traversing an oil producing zone and a water injection zone, the well permitting entry of water and oil into the wellbore, the oil and water at least partially separating under the influence of gravity to define an oil region and a water region within the wellbore, the apparatus comprising:

a first pump disposed in the oil region and having a first inlet disposed in the oil region and a first outlet above the earth's surface for discharging oil;

a second pump disposed in the oil region and having a second inlet extending remotely to the water region and a second outlet disposed adjacent to the water injection zone; and a drive motor disposed in the oil region and close coupled to the first and second pumps for driving the first and second pumps, whereby the first pump draws oil from the oil region and discharges oil through the first outlet and the second pump draws water from the water region and discharges water to the water injection zone.

2. The apparatus of claim 1, wherein the first inlet is remote from the first pump and the second inlet is remote from the second pump.

3. The apparatus of claim 1, further comprising a motor protector disposed adjacent to the drive motor, the motor protector at least partially insulating the drive motor from pressure and temperature variations within the wellbore.

4. The apparatus of claim 1, further comprising a packer sealingly disposed within the wellbore and traversed by the second outlet, the packer isolating the water injection zone within the wellbore.

5. An apparatus for producing an oil separated well, the well including a wellbore traversing an oil producing zone and a water injection zone, the well permitting entry of water and oil into the wellbore, the oil and water at least partially separating under the influence of gravity to define an oil region and a water region within the wellbore, the apparatus comprising:

a first pump having a remote first inlet disposed in the oil region for drawing oil from the oil region, and a remote first outlet disposed above the earth's surface for discharging oil;

second pump disposed adjacent to the first pump and having a second inlet in the water region for drawing water from the water region, and a remote second outlet in the water injection zone; and a drive motor operatively coupled to the first and second pumps, whereby the first pump draws oil from the oil region and discharges oil through the first outlet and the second pump draws water from the water region and discharges water to the water injection zone;

wherein the first or the second inlet includes a shroud at least partially surrounding the drive motor for directing flow around the drive motor and thereby for cooling the drive motor during operation.

6. The apparatus of claim 5, further comprising a motor protector disposed adjacent to the drive motor, the motor protector at least partially insulating the drive motor from pressure and temperature variations within the wellbore.

7. The apparatus of claim 5, further comprising a packer sealingly disposed within the wellbore and traversed by the second outlet, the packer isolating the water injection zone within the wellbore.

8. The apparatus of claim 5, wherein the drive motor is close coupled to the first and second pumps.

9. The apparatus of claim 5, wherein the remote first inlet includes a length of coil tubing extending from the first pump to the oil region of the well.

10. An apparatus for producing an oil separated well, the well including a wellbore traversing an oil producing zone and a water injection zone, the well permitting entry of water and oil into the wellbore, the oil and water at least partially separating under the influence of gravity to define an oil region and a water region within the wellbore, the apparatus comprising:

a first pump having a first inlet disposed in the oil region for drawing oil from the oil region, and a remote first outlet disposed above the earth's surface for discharging oil;

a second pump disposed adjacent to the first pump and having a remote second inlet in the water region for drawing water from the water region, and a remote second outlet in the water injection zone; and a drive motor operatively coupled to the first and second pumps, whereby the first pump draws oil from the oil region and discharges oil through the first outlet and the second pump draws water from the water region and discharges water to the water injection zone;

the first inlet including a shroud at least partially surrounding the first pump and the drive motor, the shroud directing flow into the first pump at least partially over the drive motor to cool the drive motor during operation.

11. The apparatus of claim 10, wherein the drive motor is close coupled to the first and second pumps.

12. The apparatus of claim 10, further comprising a motor protector disposed adjacent to the drive motor, the motor protector at least partially insulating the drive motor from pressure and temperature variations within the wellbore.

13. The apparatus of claim 10, further comprising a packer sealingly disposed within the wellbore and traversed by the second inlet, the packer isolating the water injection zone within the wellbore.

14. The apparatus of claim 10, wherein the remote second inlet includes a length of coil tubing extending from the second pump to the water region of the well.

15. An apparatus for producing an oil separated well, the well including a wellbore traversing an oil producing zone and a water injection zone, the well permitting entry of water and oil into the wellbore, the oil and water at least partially separating under the influence of gravity to define an oil region and a water region within the wellbore, the apparatus comprising:

a submersible pumping unit including a first pump, a second pump and a drive motor close coupled with the first and second pumps for driving the first and second pumps;

first intake means for drawing fluid from the oil region into the first pump;

second intake means for drawing fluid from the water region into the second pump;

first discharge means for discharging fluid from the first pump to a location above the earth's surface; and second discharge means for discharging fluid from the second pump to a location adjacent to the water discharge zone;

wherein both the first and second intake means extend remotely from the pumping unit.

16. The apparatus of claim 15, further comprising a motor protector disposed adjacent to the drive motor, the motor protector at least partially insulating the drive motor from pressure and temperature variations within the wellbore.

17. The apparatus of claim 15, further comprising a packer sealingly disposed within the wellbore and traversed by the second discharge means, the packer isolating the water injection zone within the wellbore.

18. The apparatus of claim 15, wherein the at least one of the first and second intake means extending remotely from the pumping unit includes a length of coil tubing extending from the pumping unit.

19. A method for producing an oil separated well, the well including a wellbore traversing an oil producing zone and a water injection zone, the well permitting entry of water and oil into the wellbore, the oil and water at least partially separating under the influence of gravity to define a first region and a second region within the wellbore, the method comprising the steps of:

(a) positioning a pumping unit in the first region, the pumping unit including a first pump and a second pump, the first and second pumps being close coupled to one another, the first pump having a first inlet and a first outlet, the second pump having a second inlet and a second outlet;

(b) extending a remote intake from the second pump to the second region; and (c) driving the first and second pumps with a drive motor to draw fluid from the first region into the first pump at least partially over the drive motor to cool the drive motor, and to discharge fluid from the first region via the first outlet, and to draw fluid from the second region into the second pump via the remote intake and discharge fluid from the second pump via the second outlet.

20. The method of claim 19, wherein the drive motor is close coupled with the first and second pumps.

21. The method of claim 19, wherein the first region is a substantially oil-filled region and the second region is a substantially water-filled region, and wherein the first outlet extends to the earth's surface for discharging oil and the second outlet extends to a location adjacent to the water injection zone.

22. The method of claim 19, wherein the first region is a substantially water-filled region and the second region is a substantially oil-filled region, and wherein the first outlet extends to a location adjacent to the water injection zone and the second outlet extends to the earth's surface for discharging oil.

23. The method of claim 19, comprising the further step of extending a second remote intake from the first pump to a location in the first region remote from the pumping unit.

24. The method of claim 19, comprising the further step of positioning at least one packer within the wellbore to isolate the water injection zone from the producing zone.

25. A method for producing an oil separated well, the well including a wellbore traversing an oil producing zone and a water injection zone, the well permitting entry of water and oil into the wellbore, the oil and water at least partially separating under the influence of gravity to define an oil region primarily containing oil and a water region primarily containing water within the wellbore, the method comprising the steps of:

(a) positioning a pumping unit in the wellbore in the oil region, the pumping unit including a first pump, a second pump and a drive motor, the first pump, the second pump and the drive motor being close coupled to one another, the first pump having a first inlet and a first outlet, the second pump having a second inlet and a second outlet;

(b) extending a remote intake from the first inlet to the water region; and (c) driving the first and second pumps with the drive motor to draw fluid from the first region into the first pump via the remote intake and discharge fluid from the first region via the first outlet, and to draw fluid from the second region into the second pump and discharge fluid from the second pump via the second outlet.

26. The method of claim 25, comprising the further step of extending a second remote intake from the second pump to a desired level within the oil region.

27. The method of claim 25, wherein the pumping unit is positioned below the water injection zone, and wherein the method includes the further step of positioning at least one packer within the wellbore to isolate the water injection zone from the producing zone.

28. The method of claim 25, comprising the further step of drawing fluid into the second pump at least partially over the drive motor to cool the drive motor.

29. The method of claim 25, comprising the further step of positioning at least one packer within the wellbore adjacent to the water injection zone to isolate the water injection zone from the producing zone.

* * * * *